US010029482B2

(12) United States Patent
Okawa et al.

(10) Patent No.: US 10,029,482 B2
(45) Date of Patent: Jul. 24, 2018

(54) DEVICE AND METHOD FOR FORMING IMAGE

(75) Inventors: Masakatsu Okawa, Tomi (JP); Yuko Hishida, Tomi (JP); Tomotaka Furuhata, Tomi (JP)

(73) Assignee: Mimaki Engineering Co., LTD, Tomi, Nagano (JP)

( * ) Notice: Subject to any disclaimer, the term of this patent is extended or adjusted under 35 U.S.C. 154(b) by 0 days.

(21) Appl. No.: 13/578,385

(22) PCT Filed: Feb. 10, 2011

(86) PCT No.: PCT/JP2011/052862

§ 371 (c)(1),
(2), (4) Date: Sep. 14, 2012

(87) PCT Pub. No.: WO2011/099559

PCT Pub. Date: Aug. 18, 2011

(65) Prior Publication Data

US 2012/0327147 A1 Dec. 27, 2012

(30) Foreign Application Priority Data

Feb. 12, 2010 (JP) ..... 2010-029104

(51) Int. Cl.
*B41J 29/38* (2006.01)
*B41J 11/00* (2006.01)
*B41J 2/21* (2006.01)

(52) U.S. Cl.
CPC ..... *B41J 11/002* (2013.01); *B41J 2/2114* (2013.01)

(58) Field of Classification Search
CPC ..... B41J 11/002
See application file for complete search history.

(56) References Cited

U.S. PATENT DOCUMENTS 7,275,804 B2 * 10/2007 Matsushima ..... 347/40
2003/0081097 A1 * 5/2003 Gil et al. ..... 347/102
(Continued)

FOREIGN PATENT DOCUMENTS

CN 101412316 A 4/2009
CN 101417534 A 4/2009
(Continued)

OTHER PUBLICATIONS

Otsuka, Tadakazu, Inkjet Recording Device, Dec. 10, 2009, JPO Translation (dossier1.ipdl.inpit.go.jp/AIPN/odse_top_dn.idp1?N0000=7400).*

(Continued)

*Primary Examiner* — Matthew Luu
*Assistant Examiner* — Tracey McMillion
(74) *Attorney, Agent, or Firm* — Finnegan, Henderson, Farabow, Garrett & Dunner

(57) ABSTRACT

An ultraviolet curing ink can be sufficiently leveled, and attachment of, for example, dust can be prevented. In an ink-jet printer, a carriage capable of reciprocating in a scanning direction is mounted with an ink-jet head for ejecting a color ink and a clear ink and ultraviolet irradiation devices for emitting ultraviolet rays. A control unit performs control so that in the forward movement of the carriage, a color ink is ejected and applied to a medium, and in the backward movement of the carriage, ultraviolet rays are irradiated to the color ink deposited on the medium and the color ink is cured. Subsequently, the medium is fed in a feed direction, and the clear ink is ejected and applied to the surface of the cured color ink in the forward movement of the carriage. In the backward movement of the carriage, the clear ink applied to the medium is irradiated by ultraviolet rays and is cured.

4 Claims, 11 Drawing Sheets

(56) References Cited

U.S. PATENT DOCUMENTS

| | | | | |
|---|---|---|---|---|
| 2007/0013757 | A1 | 1/2007 | Ohnishi | |
| 2007/0024686 | A1 * | 2/2007 | Kadomatsu | B41J 2/15 347/102 |
| 2008/0192100 | A1 * | 8/2008 | Nakajima | 347/102 |

FOREIGN PATENT DOCUMENTS

| | | | | |
|---|---|---|---|---|
| CN | 101607470 | A | 12/2009 | |
| EP | 1215333 | A2 * | 6/2002 | |
| EP | 1 349 733 | B1 | 11/2004 | |
| JP | 2008-229945 | A | 2/2008 | |
| JP | 2010-005934 | A | 1/2010 | |
| JP | 2010-5934 | A | 1/2010 | |
| WO | WO 2009-148074 | A1 | 12/2009 | |
| WO | WO2009/148074 | A1 | 12/2009 | |
| WO | WO 2009148074 | A1 * | 12/2009 | B41J 11/002 |

OTHER PUBLICATIONS

Notification of First Office Action, issued from the State Intellectual Property Office of the People's Republic of China in corresponding Application No. 201180018927.2, dated Apr. 18, 2014, 8 pages including translation.

Notification of Reason for Rejection, issued from the Japanese Patent Office in counterpart Application No. 2011-553887, dated Jan. 21, 2013, 8 pages including translation.

Notification of Preliminary Rejection, issued from the Korean Intellectual Property Office in counterpart Application No. 10-2012-7020955, dated Sep. 30, 2013, 6 pages.

Search Report listing relevant documents, issued from the State Intellectual Property Office of the People's Republic of China in corresponding Application No. 201180018927.2.

* cited by examiner

DEVICE AND METHOD FOR FORMING IMAGE

FIELD OF THE INVENTION

The present invention relates to a device and a method for forming an image by discharging an ultraviolet curable ink on a recording medium.

BACKGROUND

An inkjet printer for forming an image on a medium (recording medium) by using an ultraviolet curable color ink (color ink) for forming (printing) a color image and an ultraviolet curable ink with translucency (clear ink) for glossing the color image is generally known. (For example, Japanese Unexamined Patent Application Publication No. 2008-229945). An ultraviolet curable ink has a property of becoming hardened when being exposed to ultraviolet. Before becoming hardened, the ink may collect dust and the like. Therefore, in order to inhibit such collection or adhesion of dust, conventionally ultraviolet is irradiated to an ultraviolet curable ink landed on a medium (recording medium) at the same time as or immediately after the ink is discharged.

An ultraviolet curable ink is discharged as an ink drop from an inkjet head, and therefore the ultraviolet curable ink landed on a medium has an uneven surface. In the meantime, in the case of a conventional inkjet printer as described above, the ultraviolet curable ink is hardened immediately after it has landed on the medium. Therefore, unfortunately the ultraviolet curable ink is not sufficiently smoothened (through leveling) so that an unleveled surface becomes noticeable in a coated film formed by a hardened substance of the ultraviolet curable ink to result in a poor appearance.

Meanwhile, for the purpose of leveling the ultraviolet curable ink, it is also conceived to employ an inkjet printer in which positions of an inkjet head and an ultraviolet irradiation unit installed in a carriage are displaced from each other in a transfer direction of a medium. In such an inkjet printer, at first the carriage reciprocates in a scanning direction and discharges an ultraviolet curable ink. After the reciprocating motion of the carriage finishes, the medium is transferred in a feed direction perpendicular to the scanning direction. Then, after the transfer motion of the medium finishes, the carriage reciprocates again in the scanning direction in order to irradiate the ultraviolet curable ink, discharged onto the medium, with ultraviolet. Through these operation steps, however, dust and the like adhere to the ultraviolet curable ink yet to be cured or hardened at the time of transferring the medium. Therefore, the above-described problem that the conventional technology has cannot be solved.

SUMMARY OF INVENTION

It is an object of the present invention, therefore, to provide a device and a method for forming an image that can sufficiently level an ultraviolet curable ink and inhibit adhesion of dust and the like to the ultraviolet curable ink.

An image forming device that discharges an ultraviolet curable ink onto a recording medium, includes: a carriage that can reciprocate in a scanning direction; an ink discharger installed in the carriage for discharging liquid drops of an ultraviolet curable ink; an ultraviolet irradiator installed in the carriage for emitting ultraviolet; and a controller for controlling transfer operation by the carriage, controlling ink discharging operation by the ink discharger, and controlling ultraviolet irradiation operation by the ultraviolet irradiator; wherein, the controller has the ink discharger to discharge an ultraviolet curable ink toward the recording medium during an outward motion of the carriage; and the controller has the ultraviolet curable ink irradiated with ultraviolet during a backward motion of the carriage, the ultraviolet curable ink having been discharged from the ink discharger and landed onto the recording medium.

In the image forming device, during the outward motion of the carriage in the scanning direction, the ultraviolet curable ink is discharged onto the medium. In contrast, during the backward motion of the carriage in the scanning direction, the ultraviolet curable ink landed on the medium is irradiated with ultraviolet. As a result, a predetermined delay time can be secured after the ultraviolet curable ink is landed on the medium, until the ultraviolet curable ink is irradiated with ultraviolet. Therefore, an uneven surface of the ultraviolet curable ink landed on the medium can be smoothed (through leveling). Furthermore, in comparison to a case where ultraviolet curable ink is irradiated with ultraviolet after the ultraviolet curable ink is discharged onto a medium, and then the medium is transferred, it is possible to shorten a time period after landing of the ultraviolet curable ink onto the medium until irradiation of ultraviolet. Therefore, this operation inhibits adhesion of dust and the like to the ultraviolet curable ink before the ultraviolet curable ink becomes hardened, and the operation makes it possible to shorten a time period for forming an image.

In this case, it is preferable that the amount of the ultraviolet curable ink discharged by the ink discharger through one-time scanning is within a range of 1,400 to 3,400 pl/mm2. When the amount of the ultraviolet curable ink discharged by the ink discharger is so controlled in this way as to increase the discharge amount of the ultraviolet curable ink per unit area to 1,400 through 3,400 pl/mm2, it becomes likely that neighboring liquid of the ultraviolet curable ink landed on the recording medium is easily mixed, so as to enable promotion of leveling the ultraviolet curable ink. Thus, within a period of a round-trip motion of the carriage, an uneven surface of the ultraviolet curable ink landed on the recording medium can sufficiently be leveled.

Then, it is preferable that the ultraviolet irradiator is equipped with an ultraviolet light-emitting diode. For example, if used is an ultraviolet irradiator such as a metal halide lamp, with which switching ON/OFF cannot be done quickly, it becomes necessary to additionally prepare a shutter and a shutter operation unit. Thus, a use of an ultraviolet light-emitting diode as the ultraviolet irradiator makes it possible to turn ON/OFF ultraviolet irradiation quickly. Accordingly, without installing any extra device, such as a shutter, ultraviolet can be emitted only when ultraviolet irradiation is needed. Therefore, energy saving can be materialized.

Moreover, it is preferable that the ink discharger is able to discharge ultraviolet curable color ink and ultraviolet curable ink with translucency. If ultraviolet curable ink with translucency is discharged after discharging ultraviolet curable color ink, a surface of the ultraviolet curable color ink can be coated with the ultraviolet curable ink with translucency. Therefore, an image formed with the ultraviolet curable color ink can be provided with a gloss.

In this case, the controller may operate in such a way that: the controller has the ink discharger discharge ultraviolet curable color ink during the outward motion of the carriage, and the controller has the ultraviolet curable color ink irradiated with ultraviolet during a backward motion of the carriage, the ultraviolet curable color ink having been landed onto the recording medium; and subsequently, the controller has the ink discharger discharge ultraviolet curable ink with translucency onto a surface of the ultraviolet curable color ink landed on the recording medium during the outward motion of the carriage, and the controller has the ultraviolet curable ink with translucency irradiated with ultraviolet during the backward motion of the carriage, the ultraviolet curable ink with translucency having been landed onto the recording medium. Thus, while the carriage reciprocating, the ultraviolet curable color ink is discharged and irradiated with ultraviolet. Subsequently, while the carriage reciprocating, the ultraviolet curable ink with translucency is discharged on the surface of the ultraviolet curable color ink and irradiated with ultraviolet. As a result of that, since the ultraviolet curable ink with translucency is applied to the surface of the ultraviolet curable color ink hardened, a glossy image can be formed without a blur of the ultraviolet curable color ink and the ultraviolet curable ink with translucency.

In the meantime, the controller may operate in such a way that: the controller has the ink discharger discharge ultraviolet curable color ink and ultraviolet curable ink with translucency in due order during the outward motion of the carriage; and the controller has the ultraviolet curable color ink and the ultraviolet curable ink with translucency irradiated with ultraviolet during the backward motion of the carriage, both the ultraviolet curable color ink and the ultraviolet curable ink with translucency having been landed onto the recording medium. Thus, when the ultraviolet curable color ink and the ultraviolet curable ink with translucency are discharged in due order during the outward motion of the carriage, the ultraviolet curable color ink and the ultraviolet curable ink with translucency can be mixed. Then, by irradiation with ultraviolet during the backward motion of the carriage, the ultraviolet curable color ink and the ultraviolet curable ink with translucency can be hardened under the mixed condition. By way of these steps, a colored coated film of clear ink can be formed.

An image forming method by discharging an ultraviolet curable ink onto a recording medium by using an image forming device including: a carriage that can reciprocate in a scanning direction; an ink discharger installed in the carriage, for discharging liquid drops of an ultraviolet curable ink; an ultraviolet irradiator installed in the carriage, for emitting ultraviolet; and a controller for controlling a transfer operation by the carriage, controlling ink discharging operation by the ink discharger, and controlling an ultraviolet irradiation operation by the ultraviolet irradiator; and the image forming method includes: discharging the ultraviolet curable ink from the ink discharger onto the recording medium during an outward motion of the carriage; and irradiating the ultraviolet curable ink ultraviolet during a backward motion of the carriage.

In the image forming method according to the present invention; an ultraviolet curable ink is discharged toward the recording medium through the ink discharging step during the outward motion of the carriage, and the ultraviolet curable ink landed on the recording medium is irradiated with ultraviolet through the ultraviolet irradiation step during the backward motion of the carriage. As a result, a predetermined delay time can be secured after the ultraviolet curable ink is landed on the medium, until the ultraviolet curable ink is irradiated with ultraviolet; and therefore an uneven surface of the ultraviolet curable ink landed on the medium can be smoothed (through leveling). Furthermore, in comparison to a case where ultraviolet curable ink is irradiated with ultraviolet after the ultraviolet curable ink is discharged onto a medium, and then the medium is transferred, it is possible to shorten a time period after landing of the ultraviolet curable ink onto the medium until irradiation of ultraviolet. Therefore, this operation inhibits adhesion of dust and the like to the ultraviolet curable ink before the ultraviolet curable ink becomes hardened, and the operation makes it possible to shorten a time period for forming an image.

According to the present invention, it becomes possible to sufficiently level an ultraviolet curable ink and to inhibit adhesion of dust and the like to the ultraviolet curable ink.

DESCRIPTION OF THE EMBODIMENTS

Figure 1:
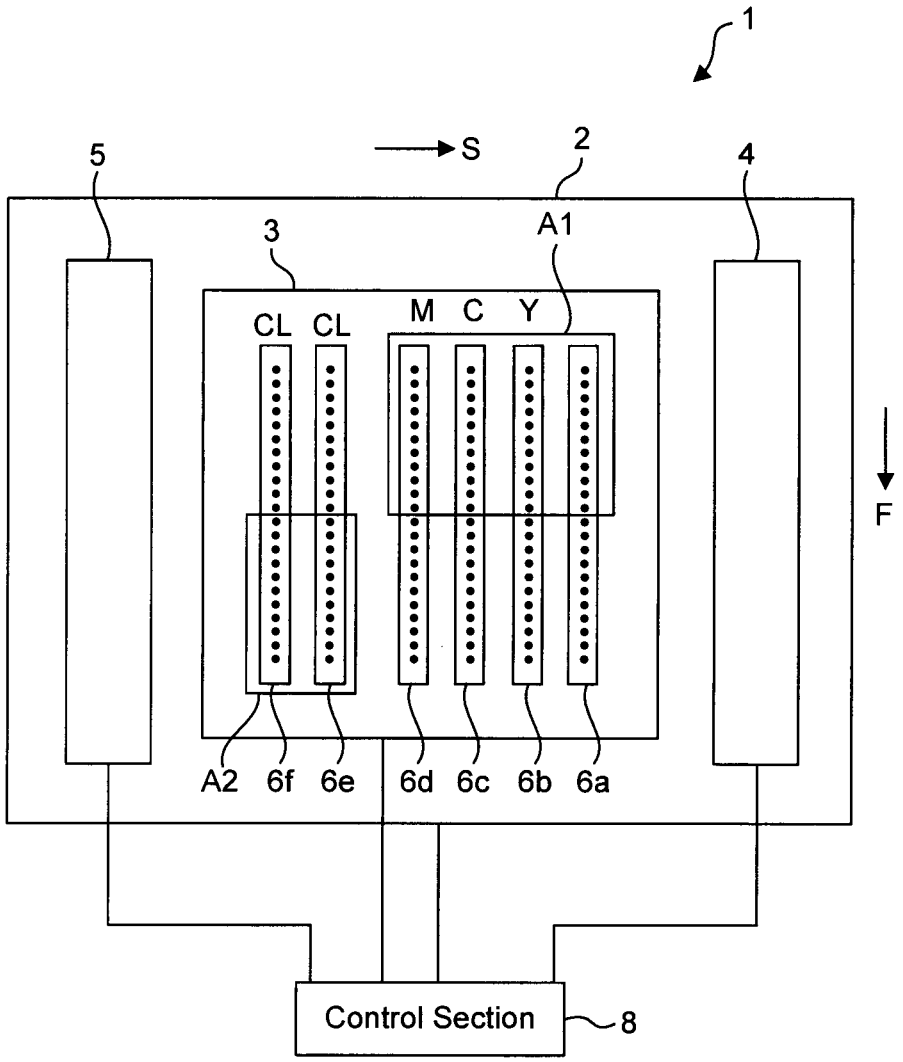
FIG. 1 is a schematic view showing an inkjet printer according to a first embodiment.

Exemplary embodiments of a device and a method for forming an image are described below in detail with reference to the accompanying drawings. An inkjet printer according to the present embodiments is an image forming device that forms an image on a medium by discharging an ultraviolet curable ink as an ink drop, and irradiating the ultraviolet curable ink, landed onto the medium, with ultraviolet for hardening the ink. Incidentally, parts or components that are identical to, or equivalent to each other are provided with the same reference numeral in all the drawings.

First Embodiment

FIG. 1 is a schematic view showing an inkjet printer according to a first embodiment. As shown in FIG. 1, an inkjet printer 1 according to a first embodiment includes a carriage 2 that can reciprocate in a scanning direction 'S', a head unit 3 that is installed in the carriage 2 and equipped with a plurality of inkjet heads 6, an ultraviolet irradiation unit 4 that is installed in the carriage 2 and placed before the head unit 3 in the scanning direction 'S', an ultraviolet irradiation unit 5 that is installed in the carriage 2 and placed after the head unit 3 in the scanning direction 'S', and a control section 8 for controlling the carriage 2, the inkjet heads 6, the ultraviolet irradiation unit 4, and the ultraviolet irradiation unit 5. Then, by means of transferring a medium each time for a distance of a pass width in a feed direction 'F' perpendicular to the scanning direction 'S', and also carrying out scanning operation with discharging ultraviolet curable ink out of the inkjet heads 6 while moving the carriage 2 in the scanning direction 'S', and irradiation with ultraviolet from the ultraviolet irradiation unit 4 as well as the ultraviolet irradiation unit 5, the inkjet printer 1 forms an image on the medium. Though the present invention is not limited to any specific number of pass operations, the present embodiment is explained with respect to a printing operation of printing with two pass operations as an example. In other words, explained is printing operation in which printing is carried out through scanning a certain print area two times (the number of pass operations) while defining one medium feed distance with a width (pass width) obtained by way of dividing the series of nozzles of the inkjet heads 6 by the number of pass operations, i.e., '2'.

The carriage 2 is supported above a platen (not shown), on which the medium is transferred, with a guide rail (not shown) stretching in the scanning direction 'S' so as to be movable. Meanwhile, a driving mechanism such as a drive motor (not shown) is installed in the carriage 2, and a drive motion of the driving mechanism enables the carriage 2 to reciprocate along the guide rail in the scanning direction 'S'. Incidentally, the driving mechanism does not necessarily need to be installed in the carriage 2, and may be installed in the inkjet printer 1 as a component independent of the carriage 2. In such a case, drive control for the carriage 2 by the control section 8, to be described later, is replaced with drive control for a driving mechanism installed in the inkjet printer 1 as a component independent of the carriage 2.

The head unit 3 is an ink discharging unit in which the plurality of inkjet heads 6 (from 6*a* through 6*f*) are assembled for discharging the ultraviolet curable ink. Since the head unit 3 is installed in the carriage 2, each of the inkjet heads 6 can discharge the ultraviolet curable ink at the time of traveling in the scanning direction 'S' in association with a traveling motion of the carriage 2. The inkjet head 6*a* through the inkjet head 6*f* are collectively placed in the scanning direction 'S' in such a way that the inkjet head 6*a*, the inkjet head 6*b*, the inkjet head 6*c*, the inkjet head 6*d*, the inkjet head 6*e*, and the inkjet head 6*f* are laid out in this order from the front to the rear in the scanning direction 'S'

In each of the inkjet heads 6, formed are a plurality of nozzles (not shown) for discharging the ultraviolet curable ink as ink drops. The plurality of nozzles make up a line of nozzles so placed as to stretch in the feed direction 'F'. Then, from the inkjet head 6*a* through the inkjet head 6*d* that are positioned at a front side in the scanning direction 'S', colored ultraviolet curable ink (hereinafter, also called "color ink") is discharged. In the meantime, from the inkjet head 6*e* and the inkjet head 6*f* that are positioned at a rear side in the scanning direction 'S', ultraviolet curable ink with translucency (hereinafter, also called "clear ink") is discharged. Concretely to describe, black color ink (K) is discharged from a line of nozzles of the inkjet head 6*a*. Yellow color ink (Y) is discharged from a line of nozzles of the inkjet head 6*b*. Cyan color ink (C) is discharged from a line of nozzles of the inkjet head 6*c*. Magenta color ink (M) is discharged from a line of nozzles of the inkjet head 6*d*. Meanwhile, clear ink (CL) is discharged from each line of nozzles of the inkjet head 6*e* and the inkjet head 6*f*.

Then, the color ink is discharged only from lines of nozzles of a first discharge area A1 that are placed as a rear half, in the feed direction 'F', of the lines of nozzles formed in the inkjet head 6*a* through the inkjet head 6*d* for discharging the color ink. In contrast, the color ink is not discharged from lines of nozzles that are placed as a front half in the feed direction 'F'. On the other hand, the clear ink is discharged only from lines of nozzles of a second discharge area A2 that are placed as a front half, in the feed direction 'F', of the lines of nozzles formed in the inkjet head 6*e* and the inkjet head 6*f* for discharging the clear ink. In contrast, the clear ink is not discharged from lines of nozzles that are placed as a rear half in the feed direction 'F'. Accordingly, for the medium transferred in the feed direction 'F', at first the color ink discharged from the first discharge area A1 of the inkjet head 6*a* through the inkjet head 6*d* is applied to a surface of the medium. Subsequently, after the medium is transferred in the feed direction 'F', the clear ink discharged from the second discharge area A2 of the inkjet head 6*e* and the inkjet head 6*f* is applied to a surface (top layer) of the color ink.

Incidentally, each of the inkjet heads 6, namely each of the inkjet head 6*a* through the inkjet head 6*f*, in the first discharge area A1 and the second discharge area A2 corresponds to an ink discharger described in the scope of claims for patent.

The ultraviolet irradiation unit 4 irradiates the ultraviolet curable ink, applied to the medium, with ultraviolet in order to harden the ultraviolet curable ink. The ultraviolet irradiation unit 4 has an ultraviolet light-emitting diode (hereinafter called "UVLED") as a main constituent element. Turning on the UVLED emits ultraviolet, and turning off the UVLED stops emitting ultraviolet. The ultraviolet irradiation unit 4 directs the UVLED toward the platen (not shown) on which the medium is transferred. Turning on the UVLED irradiates the medium, transferred on the platen, with ultraviolet; and turning off the UVLED stops irradiating the medium with ultraviolet. Incidentally, the ultraviolet irradiation unit 4 is installed in the carriage 2, and therefore it can emit ultraviolet at the time of reciprocating in the scanning direction 'S' in associating with traveling motion of the carriage 2.

In the same manner as the ultraviolet irradiation unit 4 does, the ultraviolet irradiation unit 5 irradiates the ultraviolet curable ink, applied to the medium, with ultraviolet in order to harden the ultraviolet curable ink. The ultraviolet irradiation unit 5 has an ultraviolet light-emitting diode (hereinafter called "UVLED") as a main constituent element. Turning on the UVLED emits ultraviolet, and turning off the UVLED stops emitting ultraviolet. The ultraviolet irradiation unit 5 directs the UVLED toward the platen (not shown) on which the medium is transferred. Turning on the UVLED irradiates the medium, transferred on the platen, with ultraviolet; and turning off the UVLED stops irradiating the medium with ultraviolet. Incidentally, the ultraviolet irradiation unit 5 is installed in the carriage 2, and therefore it can emit ultraviolet at the time of reciprocating in the scanning direction 'S' in associating with traveling motion of the carriage 2.

The control section 8 controls printing operation of the inkjet printer 1, and it is configured with a computer as a key unit, the computer including, for example, a CPU, a ROM, and a RAM. Each operation control of the control section 8, to be described later, is put into practice by way of loading predetermined computer software into the CPU and/or the RAM, and executing the software under the control of the CPU.

The control section 8 controls driving operation of the carriage 2 to reciprocate the carriage 2 in the scanning direction 'S'.

Furthermore, the control section 8 controls ink discharging operation of the inkjet heads 6 during outward motion of the carriage 2 to discharge the color ink from the first discharge area A1 of the inkjet head 6*a* through the inkjet head 6*d*, and discharge the clear ink from the second discharge area A2 of the inkjet head 6*e* and the inkjet head 6*f*. Under this situation, the control section 8 controls ink discharging operation of the inkjet head 6*e* and the inkjet head 6*f* in such a way that the amount of clear ink discharged from each of the inkjet head 6*e* and the inkjet head 6*f* by one scanning operation (one pass operation) is 1,400 to 3,400 pl/mm2. As a result, the clear ink discharged from the inkjet head 6*e* and the inkjet head 6*f* totally amounts to 2,800 to 6,800 pl/mm2. Moreover, in the case of forming an image through a plurality of pass operations, the clear ink discharged from each of the inkjet head 6*e* and the inkjet head 6*f* totally amounts to 1,400 to 3,400 pl/mm2 multiplied by the number of pass operations. For example, in the case of forming an image through 12 pass operations, the clear ink discharged from each of the inkjet head 6*e* and the inkjet head 6*f* amounts to 1,400 to 3,400 pl/mm2 multiplied by 12, namely 16.8 to 40.8 nl/mm2. As a result, the clear ink discharged from the inkjet head 6*e* and the inkjet head 6*f* totally amounts to 33.6 to 81.6 nl/mm2. Incidentally, as a method for increasing the amount of discharged clear ink per unit area, any means may be applied. For example, listed may be a means in which a traveling speed of the carriage 2 is reduced in order to increase the amount of liquid drops discharged from each of the inkjet head 6*e* and the inkjet head 6*f*; another means in which a discharge density of the liquid drops discharged from the inkjet head 6*e* and the inkjet head 6*f* is increased, still another means in which the number of inkjet heads for discharging the clear ink is increased; and the like. Incidentally, in regard to the color ink discharged from the inkjet head 6*a* through the inkjet head 6*d*, the discharge amount is appropriately set in accordance with a color image to be formed.

Furthermore, the control section 8 controls ultraviolet irradiating operation of the ultraviolet irradiation unit 4 and the ultraviolet irradiation unit 5 during a backward motion of the carriage 2 to turn on the UVLEDs of the ultraviolet irradiation unit 4 and the ultraviolet irradiation unit 5. Namely, the control section 8 turns on the UVLEDs of the ultraviolet irradiation unit 4 and the ultraviolet irradiation unit 5 at the time of starting the backward motion of the carriage 2, and it turns off the UVLEDs of the ultraviolet irradiation unit 4 and the ultraviolet irradiation unit 5 at the end of the backward motion. Thus, during the backward motion of the carriage 2, the UVLEDs of the ultraviolet irradiation unit 4 and the ultraviolet irradiation unit 5 keep on being lighted. Incidentally, the control section 8 may keep the UVLEDs of the ultraviolet irradiation unit 4 and the ultraviolet irradiation unit 5 turned on only while the carriage 2 is moving over the medium or the printed image, and it may keep the same lighted off while the carriage 2 is not positioned over the medium or the printed image. Moreover, if the color ink and the clear ink are hardened by ultraviolet irradiation from either of the ultraviolet irradiation unit 4 and the ultraviolet irradiation unit 5, it is not needed to irradiate with ultraviolet from both the ultraviolet irradiation unit 4 and the ultraviolet irradiation unit 5. In such a case, the control section 8 controls ultraviolet irradiating operation of only one of the ultraviolet irradiation unit 4 and the ultraviolet irradiation unit 5.

Figure 2:
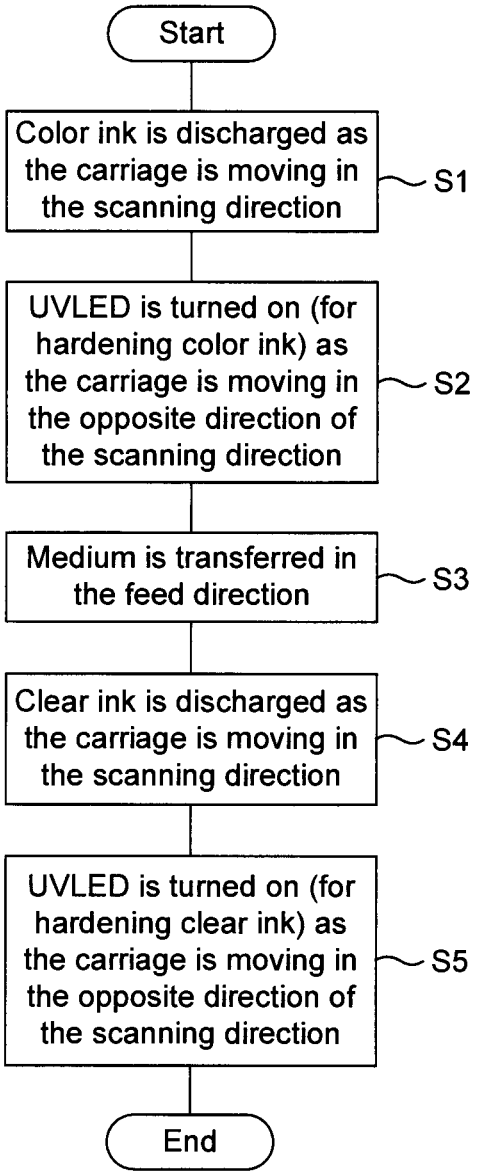
FIG. 2 is a flowchart showing a process workflow of a control section.

Next, a printing method by using the inkjet printer 1 is explained with reference to FIG. 2. FIG. 2 is a flowchart showing a process workflow of the control section. Incidentally, printing operation of the inkjet printer 1 explained below is carried out under the control of the control section 8. Namely, steps described below are carried out by a processing unit, configured with a CPU and the like (not shown) that integrally controls the carriage 2, the inkjet heads 6, the ultraviolet irradiation unit 4, and the ultraviolet irradiation unit 5 according to a program recorded in a storage device, such as a ROM and the like, in the control section 8.

At first, the control section 8 controls driving operation of the carriage 2 to reciprocate the carriage 2 in the scanning direction 'S'.

Then, during the outward motion of the carriage 2, the control section 8 controls ink discharging operation of the inkjet heads 6, while moving the carriage 2 in the scanning direction 'S', in order to discharge the color ink from the first discharge area A1 (Step S1).

As the color ink is discharged from the first discharge area A1 in this way, liquid drops of the color ink discharged from the first discharge area A1 are landed on a medium 'M' so that the color ink is applied to a scanning line of the first discharge area A1.

Then, during the backward motion of the carriage 2, the control section 8 controls ultraviolet irradiating operation of the ultraviolet irradiation unit 4 and the ultraviolet irradiation unit 5, while moving the carriage 2 in the scanning direction 'S', in order to turn on the UVLED of the ultraviolet irradiation unit 4 and the UVLED of the ultraviolet irradiation unit 5 (Step S2). Accordingly, the color ink applied to the medium 'M' is hardened by way of irradiation with the ultraviolet emitted from the UVLEDs turned on.

After the reciprocating motion of the carriage 2 in the scanning direction 'S' finishes, the control section 8 turns off the UVLED of the ultraviolet irradiation unit 4 and the UVLED of the ultraviolet irradiation unit 5, and then transfers the medium 'M' for a pass width in the feed direction 'F' (Step S3).

Next, the control section 8 controls driving operation of the carriage 2 to reciprocate the carriage 2 in the scanning direction 'S'.

Then, during the outward motion of the carriage 2, the control section 8 controls ink discharging operation of the inkjet heads 6, while moving the carriage 2 in the scanning direction 'S', in order to discharge the clear ink from the second discharge area A2 (Step S4). Under this situation, the control section 8 controls ink discharging operation of the inkjet heads 6 in such a way that the amount of clear ink discharged from each of the inkjet head 6*e* and the inkjet head 6*f* is 1,400 to 3,400 pl/mm2.

As the clear ink is discharged from the second discharge area A2 in this way, liquid drops of the clear ink discharged from the second discharge area A2 are landed on the medium 'M' so that the clear ink is applied to a surface of the color ink hardened. Then, the clear ink is not yet hardened at the stage, and therefore each of the liquid drops of the clear ink landed on the medium 'M' extends gradually to decrease in its thickness so that an uneven surface of the clear ink is leveled on the surface of the color ink hardened. Moreover, because of high density of the liquid drops of the clear ink, contact and mixing of the neighboring liquid drops of the clear ink among their interrelation are likely to happen so that each of the liquid drops of the clear ink further decreases in its thickness to promote leveling of the clear ink.

Then, during the backward motion of the carriage 2, the control section 8 controls ultraviolet irradiating operation of the ultraviolet irradiation unit 4 and the ultraviolet irradiation unit 5, while moving the carriage 2 in the scanning direction 'S', in order to turn on the UVLED of the ultraviolet irradiation unit 4 and the UVLED of the ultraviolet irradiation unit 5 (Step S5). Accordingly, the clear ink applied to the medium 'M' is hardened by way of irradiation with the ultraviolet emitted from the UVLEDs turned on.

After the reciprocating motion of the carriage 2 in the scanning direction 'S' finishes, the control section 8 turns off the UVLED of the ultraviolet irradiation unit 4 and the UVLED of the ultraviolet irradiation unit 5. Then, the control section 8 repeats the steps described above until an entire image is formed.

An example of printing operation according to the method described above is specifically explained with reference to FIG. 3A, FIG. 3B, FIG. 4A, FIG. 4B and FIG. 5A through FIG. 5C. FIG. 3A, FIG. 3B, FIG. 4A and FIG. 4B are diagrams showing an operation example for explaining printing operation, and meanwhile FIG. 5A through FIG. 5C are diagrams showing status of ink applied on a medium.

Figure 3A:
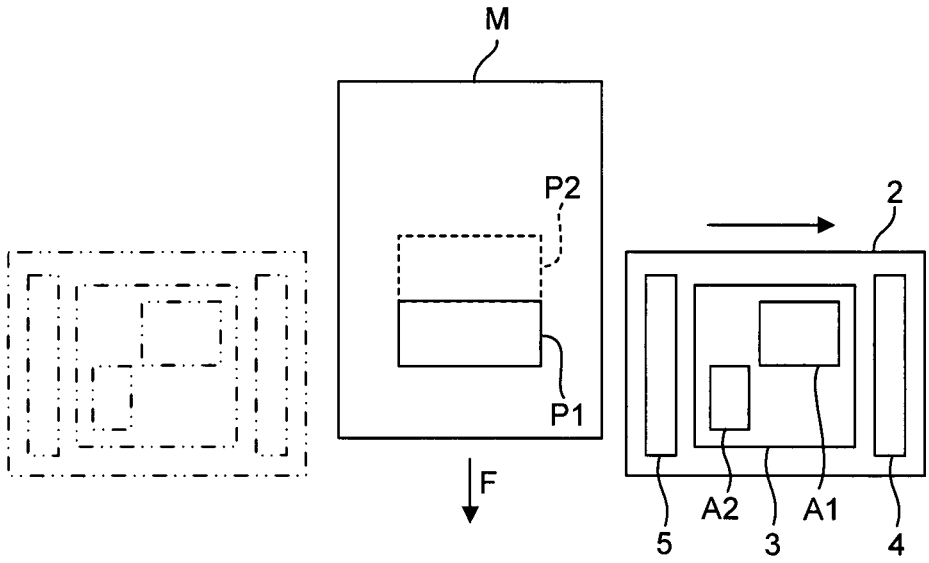
FIG. 3A and FIG. 3B are diagrams showing an exemplary operation for explaining a printing operation.
Figure 3B:
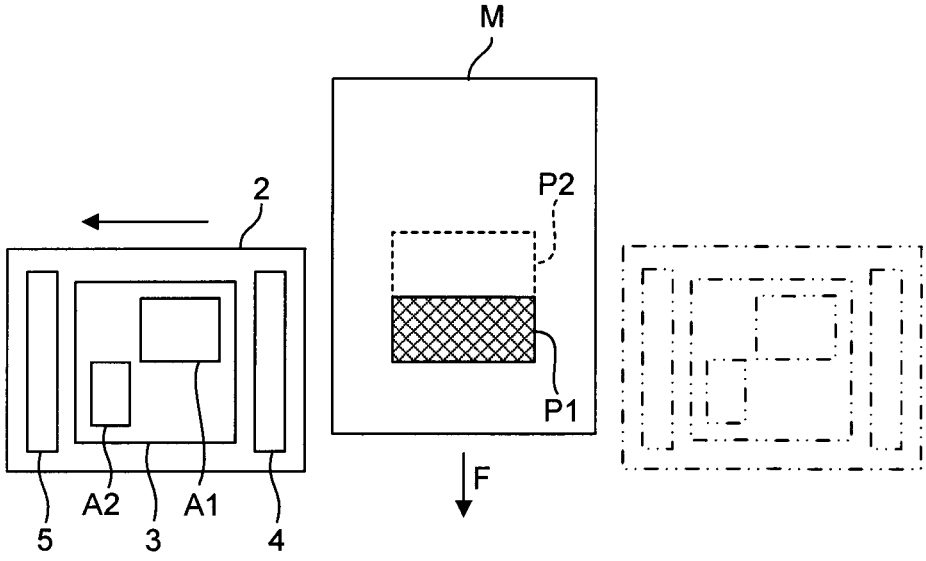

At first, as shown in FIG. 3A and FIG. 3B, the medium 'M' is transferred in the feed direction 'F' so as to have an area P1 of the medium 'M' meet a scanning line of the first discharge area A1, and then the carriage 2 reciprocates in the scanning direction 'S'.

Then, as shown in FIG. 3A, during the outward motion of the carriage 2, the color ink is discharged from the first discharge area A1 while the carriage 2 is moving in the scanning direction 'S' under a situation where the UVLEDs of the ultraviolet irradiation unit 4 and the ultraviolet irradiation unit 5 are turned off. As a result of that, the color ink discharged from the first discharge area A1 is applied to the area P1.

In contrast, as shown in FIG. 3B, during the backward motion of the carriage 2, the carriage 2 moves in an opposite direction of the scanning direction 'S' under a situation where the UVLEDs of the ultraviolet irradiation unit 4 and the ultraviolet irradiation unit 5 are turned on. As a result of that, the color ink applied to the area P1 is hardened by means of ultraviolet irradiation.

FIG. 5A shows a situation of the area P1 at the time. As shown in FIG. 5A, color ink D1 applied to the area P1 is hardened by means of ultraviolet irradiation. Incidentally, although the color ink D1 is hardened while having a form of a liquid drop, as shown in FIG. 5A; sometimes the color ink D1 may be more leveled, depending on the volume of the color ink D1 itself discharged, intensity of ultraviolet irradiation, and the like.

Figure 4A:
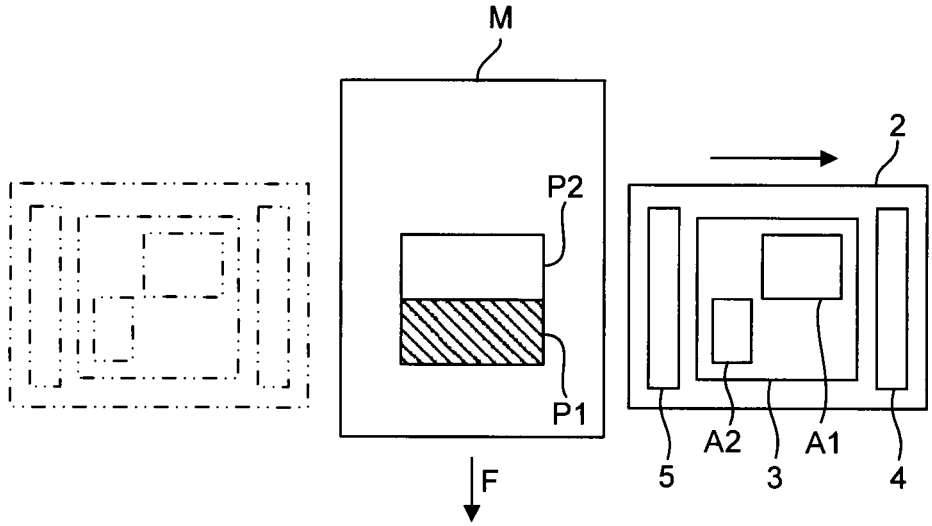
FIG. 4A and FIG. 4B are diagrams showing the exemplary operation for explaining the printing operation.
Figure 4B:
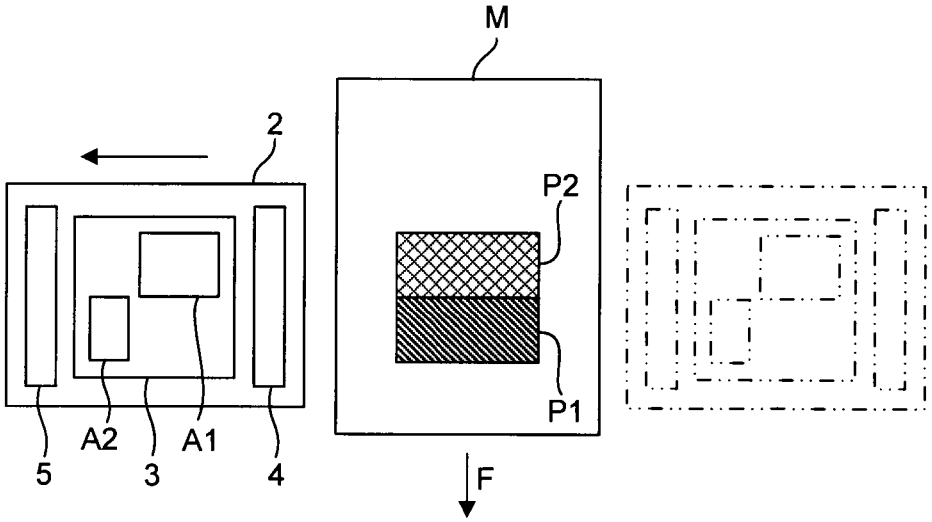
Figure 5A:
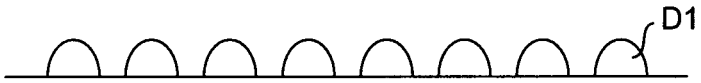
FIG. 5A through FIG. 5C are diagrams showing a status of an ink applied on a medium.
Figure 5B:
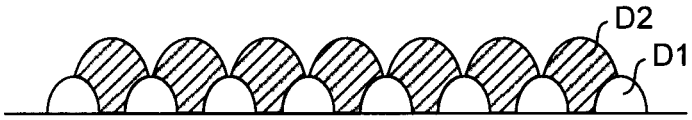
Figure 5C:
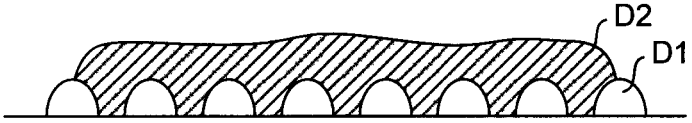

Next, as shown in FIG. 4A and FIG. 4B, the medium 'M' is transferred for a pass width in the feed direction 'F' so as to have an area P2 of the medium 'M' meet the scanning line of the first discharge area A1, and also have the area P1 of the medium 'M' meet a scanning line of the second discharge area A2, and then the carriage 2 reciprocates in the scanning direction 'S'.

Then, as shown in FIG. 4A, during the outward motion of the carriage 2, the color ink is discharged from the first discharge area A1, and the clear ink is discharged from the second discharge area A2, while the carriage 2 is moving in the scanning direction 'S' under a situation where the UVLEDs of the ultraviolet irradiation unit 4 and the ultraviolet irradiation unit 5 are turned off. As a result of that, the color ink discharged from the first discharge area A1 is applied to the area P1, and meanwhile the clear ink discharged from the second discharge area A2 is applied to the surface of the color ink hardened in the area P1. Since the UVLEDs of the ultraviolet irradiation unit 4 and the ultraviolet irradiation unit 5 are turned off under this situation, the clear ink applied to the surface of the color ink, hardened in the area P1, further decreases in its thickness to become leveled.

FIG. 5B and FIG. 5C show a situation of the area P1 at the time. More specifically, under a situation immediately after clear ink D2 is applied to the area P1, the clear ink D2 applied to the surface of the color ink D1 hardened is still in form of a liquid drop, as shown in FIG. 5B. Then, until the carriage 2 returns, no ultraviolet irradiation is carried out, and therefore each liquid drop of the clear ink D2 further decreases in its thickness, as shown in FIG. 5C, so that the clear ink D2 becomes leveled. Since the discharge amount of the clear ink D2 is especially great, the clear ink D2 is leveled more quickly.

In contrast, as shown in FIG. 4B, during the backward motion of the carriage 2, the carriage 2 moves in the opposite direction of the scanning direction 'S' under a situation where the UVLEDs of the ultraviolet irradiation unit 4 and the ultraviolet irradiation unit 5 are turned on. As a result of that, the color ink applied to the area P2 and the clear ink applied to the area P1 are hardened by means of ultraviolet irradiation.

According to the first embodiment in this way, during the outward motion of the carriage 2 in the scanning direction 'S', ultraviolet curable ink is discharged onto the medium 'M'. In contrast, during the backward motion of the carriage in the scanning direction, the ultraviolet curable ink landed on the medium 'M' is irradiated with ultraviolet. As a result, a predetermined delay time can be secured after the ultraviolet curable ink is landed on the medium 'M', until the ultraviolet curable ink is irradiated with ultraviolet; and therefore an uneven surface of the ultraviolet curable ink landed on the medium 'M' can be leveled. Moreover, increasing the discharge amount of the ultraviolet curable ink per unit area makes it likely that neighboring liquid drops of the ultraviolet curable ink landed on the medium 'M' are easily mixed, so as to enable promotion of leveling the ultraviolet curable ink. Thus, within a period of a round-trip motion of the carriage 2, an uneven surface of the ultraviolet curable ink landed on the medium 'M' can sufficiently be leveled.

Furthermore, by making use of a UVLED for the ultraviolet irradiation unit 4 and the ultraviolet irradiation unit 5, switching ON/OFF ultraviolet irradiation can be done quickly. Therefore, without installing any extra device, such as a shutter, required in the case where used is a metal halide lamp, with which switching ON/OFF ultraviolet irradiation cannot be done quickly; ultraviolet can be emitted only when ultraviolet irradiation is needed. Therefore, energy saving can be materialized.

Then, while the carriage 2 reciprocating, the color ink is discharged and irradiated with ultraviolet. Subsequently, while the carriage reciprocating, the clear ink is discharged on the surface of the color ink and irradiated with ultraviolet. As a result of that, since the clear ink is applied to the surface of the color ink hardened, a glossy image can be formed without a blur of the color ink and clear ink.

Second Embodiment

Next, an inkjet printer according to a second embodiment is explained. Although, being fundamentally similar to the inkjet printer 1 according to the first embodiment, the inkjet printer according to the second embodiment is different from the inkjet printer 1 according to the first embodiment, based on a viewpoint that an ultraviolet irradiation unit is divided in the feed direction 'F'. Thus, in an explanation below, only a difference from the first embodiment is explained, and an explanation is omitted on the same part as the first embodiment has.

Figure 6:
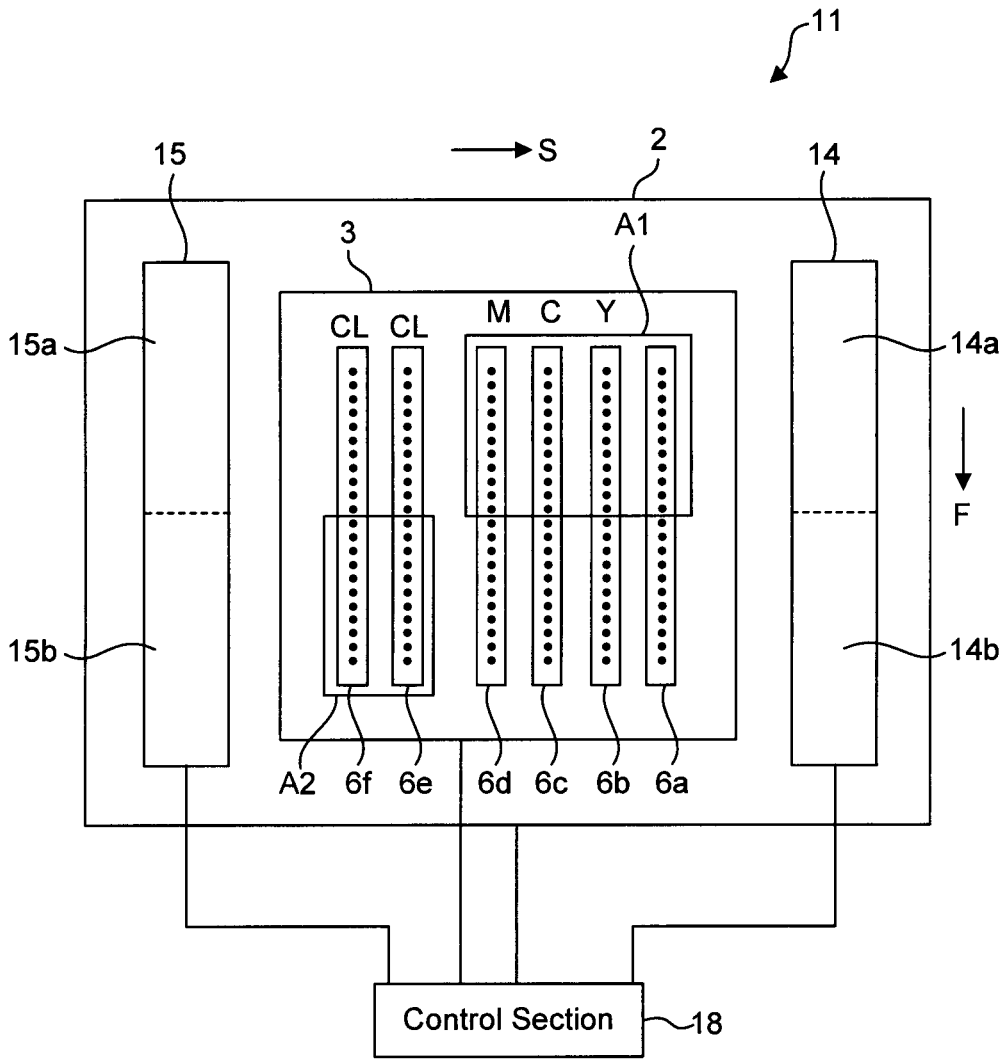
FIG. 6 is a schematic view showing an inkjet printer according to a second embodiment.

FIG. 6 is a schematic view showing an inkjet printer according to the second embodiment. As shown in FIG. 6, an inkjet printer 11 according to the second embodiment includes a carriage 2 that can reciprocate in a scanning direction 'S', a head unit 3 that is installed in the carriage 2 and equipped with a plurality of inkjet heads 6, an ultraviolet irradiation unit 14 that is installed in the carriage 2 and placed before the head unit 3 in the scanning direction 'S', an ultraviolet irradiation unit 15 that is installed in the carriage 2 and placed after the head unit 3 in the scanning direction 'S', and a control section 18 for controlling the carriage 2, the inkjet heads 6, the ultraviolet irradiation unit 14*a*, and the ultraviolet irradiation unit 14*b*. Then, by means of transferring a medium each time for a distance of a pass width in a feed direction 'F' perpendicular to the scanning direction 'S', and also carrying out scanning operation with discharging ultraviolet curable ink out of the inkjet heads 6 while moving the carriage 2 in the scanning direction 'S', and irradiation with ultraviolet from the ultraviolet irradiation unit 14 as well as the ultraviolet irradiation unit 15, the inkjet printer 11 forms an image on the medium, in the same manner as the inkjet printer 1 according to the first embodiment does.

The ultraviolet irradiation unit 14 irradiates the ultraviolet curable ink, applied to the medium, with ultraviolet in order to harden the ultraviolet curable ink. The ultraviolet irradiation unit 14 has a UVLED as a main constituent element, and then turning on the UVLED emits ultraviolet, and turning off the UVLED stops emitting ultraviolet. The ultraviolet irradiation unit 14 directs the UVLED toward the platen (not shown) on which the medium is transferred. Turning on the UVLED irradiates the medium, transferred on the platen, with ultraviolet; and turning off the UVLED stops irradiating the medium with ultraviolet. Incidentally, the ultraviolet irradiation unit 14 is installed in the carriage 2, and therefore it can emit ultraviolet at the time of reciprocating in the scanning direction 'S' in associating with traveling motion of the carriage 2.

The ultraviolet irradiation unit 14 is divided into two sections along the feed direction 'F'. The ultraviolet irradiation unit 14*a* is located at a rear-side position in the feed direction 'F', which meets the first discharge area A1 in the scanning direction 'S', and meanwhile the ultraviolet irradiation unit 14*b* is located at a front-side position in the feed direction 'F', which meets the second discharge area A2. Incidentally, the ultraviolet irradiation unit 14*a* and the ultraviolet irradiation unit 14*b* may be materialized as divided sections by means of placing physically-different units along the feed direction 'F', or they may be materialized by means of logically dividing with software control by the control section 18.

In the same manner as the ultraviolet irradiation unit 14 does, the ultraviolet irradiation unit 15 irradiates the ultraviolet curable ink, applied to the medium, with ultraviolet in order to harden the ultraviolet curable ink. The ultraviolet irradiation unit 15 has a UVLED as a main constituent element, and then turning on the UVLED emits ultraviolet, and turning off the UVLED stops emitting ultraviolet. The ultraviolet irradiation unit 15 directs the UVLED toward the platen (not shown) on which the medium is transferred. Turning on the UVLED irradiates the medium, transferred on the platen, with ultraviolet; and turning off the UVLED stops irradiating the medium with ultraviolet. Incidentally, the ultraviolet irradiation unit 15 is installed in the carriage 2, and therefore it can emit ultraviolet at the time of reciprocating in the scanning direction 'S' in associating with traveling motion of the carriage 2.

The ultraviolet irradiation unit 15 is divided into two sections along the feed direction 'F'. The ultraviolet irradiation unit 15*a* is located at a rear-side position in the feed direction 'F', which meets the first discharge area A1 in the scanning direction 'S', and meanwhile the ultraviolet irradiation unit 15*b* is located at a front-side position in the feed direction 'F', which meets the second discharge area A2. Incidentally, the ultraviolet irradiation unit 15*a* and the ultraviolet irradiation unit 15*b* may be materialized as divided sections by means of placing physically-different units along the feed direction 'F', or they may be materialized by means of logically dividing with software control by the control section 18.

The control section 18 controls printing operation of the inkjet printer 11, and it is configured with a computer as a key unit, the computer including, for example, a CPU, a ROM, and a RAM. Each operation control of the control section 18, to be described later, is put into practice by way of loading predetermined computer software into the CPU and/or the RAM, and executing the software under the control of the CPU.

The control section 18 controls driving operation of the carriage 2 to reciprocate the carriage 2 in the scanning direction 'S'.

Furthermore, the control section 18 controls ink discharging operation of the inkjet heads 6 during the outward motion of the carriage 2 to discharge the color ink from the first discharge area A1, and discharge the clear ink from the second discharge area A2. Moreover, the control section 18 controls ultraviolet irradiating operation of the ultraviolet irradiation unit 14 and the ultraviolet irradiation unit 15 to turn on the UVLEDs of the ultraviolet irradiation unit 14*a* and the ultraviolet irradiation unit 15*a*. Namely, the control section 18 turns on the UVLEDs of the ultraviolet irradiation unit 14*a* and the ultraviolet irradiation unit 15*a* at the time of starting the outward motion of the carriage 2, and it turns off the UVLEDs of the ultraviolet irradiation unit 14*a* and the ultraviolet irradiation unit 15*a* at the end of the outward motion of the carriage 2. Thus, during the outward motion of the carriage 2, the UVLEDs of the ultraviolet irradiation unit 14*a* and the ultraviolet irradiation unit 15*a* keep on being lighted. Incidentally, the control section 18 may keep the UVLEDs of the ultraviolet irradiation unit 14*a* and the ultraviolet irradiation unit 15*a* turned on only while the carriage 2 is moving over the medium or the printed image, and it may keep the same lighted off while the carriage 2 is not positioned over the medium or the printed image.

Furthermore, during the backward motion of the carriage 2, the control section 18 controls ultraviolet irradiating operation of the ultraviolet irradiation unit 14 and the ultraviolet irradiation unit 15 to turn on all the UVLEDs of the ultraviolet irradiation unit 14 and the ultraviolet irradiation unit 15. Namely, the control section 18 turns on the UVLEDs of the ultraviolet irradiation unit 14*a*, the ultraviolet irradiation unit 14*b*, the ultraviolet irradiation unit 15*a*, and the ultraviolet irradiation unit 15*b* at the time of starting the backward motion of the carriage 2, and it turns off the UVLEDs of the ultraviolet irradiation unit 14*a*, the ultraviolet irradiation unit 14*b*, the ultraviolet irradiation unit 15*a*, and the ultraviolet irradiation unit 15*b* at the end of the backward motion of the carriage 2. Thus, during the backward motion of the carriage 2, the UVLEDs of the ultraviolet irradiation unit 14*a*, the ultraviolet irradiation unit 14*b*, the ultraviolet irradiation unit 15*a*, and the ultraviolet irradiation unit 15*b* keep on being lighted. Incidentally, the control section 18 may keep all the UVLEDs of the ultraviolet irradiation unit 14 and the ultraviolet irradiation unit 15 turned on only while the carriage 2 is moving over the medium or the printed image, and it may keep all the UVLEDs of the ultraviolet irradiation unit 14 and the ultraviolet irradiation unit 15 lighted off while the carriage 2 is not positioned over the medium or the printed image.

Figure 7A:
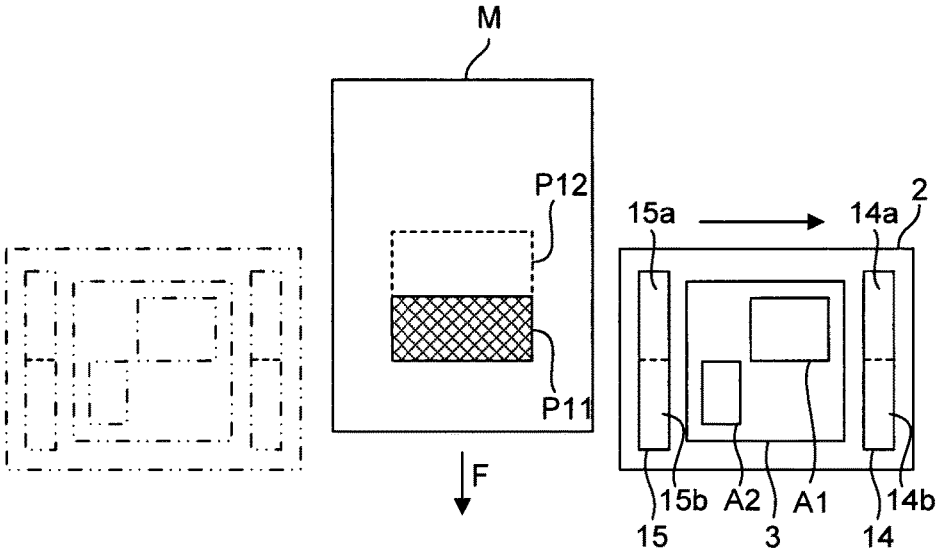
FIG. 7A and FIG. 7B are diagrams showing an exemplary operation for explaining a printing operation.
Figure 7B:
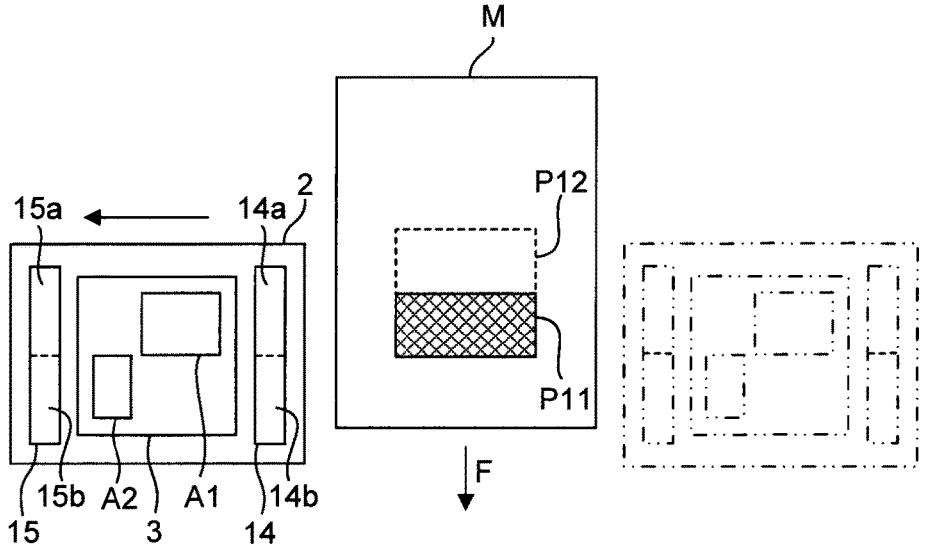
Figure 8A:
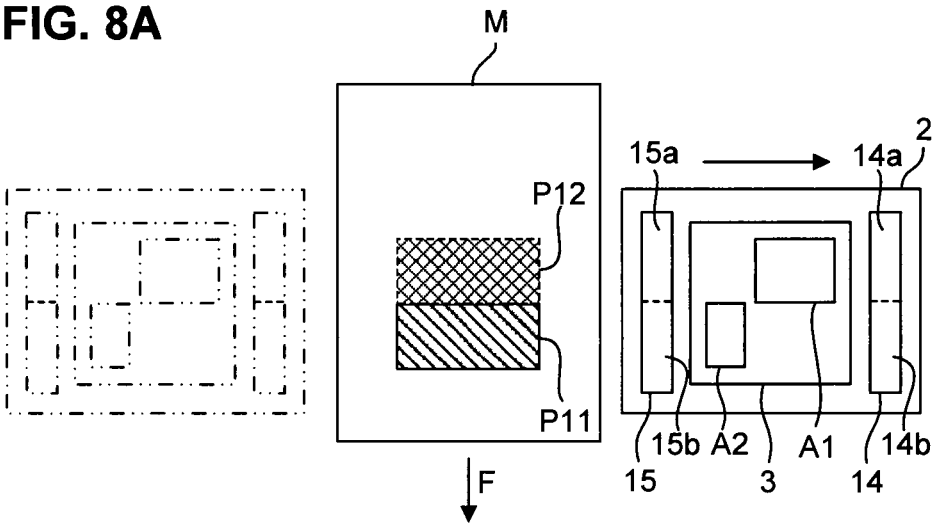
FIG. 8A and FIG. 8B are diagrams showing the exemplary operation for explaining the printing operation.
Figure 8B:
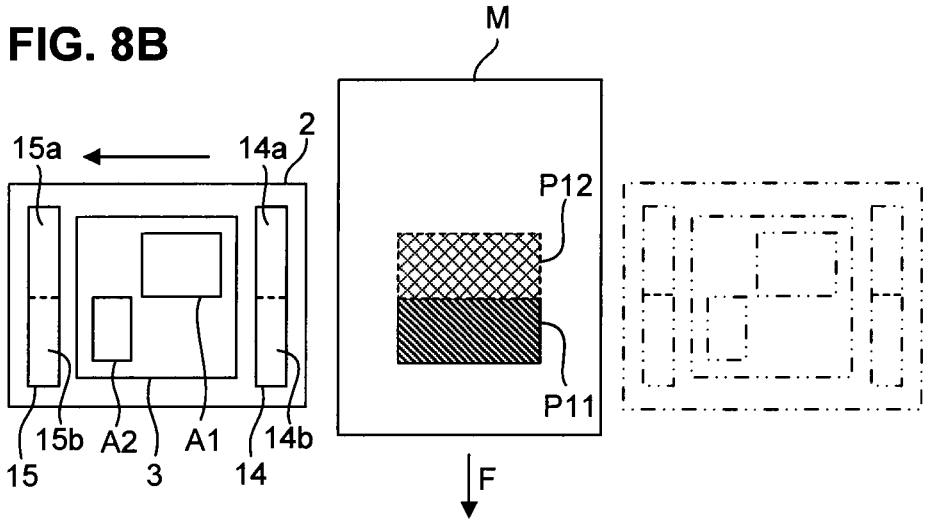

Next, an operation example of printing operation by using the inkjet printer 11 is specifically explained with reference to FIG. 7A, FIG. 7B, FIG. 8A, and FIG. 8B. FIG. 7A and FIG. 7B as well as FIG. 8A and FIG. 8B are diagrams showing the operation example for explaining printing operation.

At first, as shown in FIG. 7A and FIG. 7B, the medium 'M' is transferred in the feed direction 'F' so as to have an area P11 of the medium 'M' meet a scanning line of the first discharge area A1, and then the carriage 2 reciprocates in the scanning direction 'S'.

Then, as shown in FIG. 7A, during the outward motion of the carriage 2, the color ink is discharged from the first discharge area A1 while the carriage 2 is moving in the scanning direction 'S' under a situation where the UVLEDs of the ultraviolet irradiation unit 14*a* and the ultraviolet irradiation unit 15*a* are turned on. As a result of that, the color ink discharged from the first discharge area A1 is applied to the area P11, and also irradiated with ultraviolet so as to be hardened, immediately after being applied to the area P11. At the time, since the color ink is irradiated with a small amount of ultraviolet, the color ink is not fully hardened.

In contrast, as shown in FIG. 7B, during the backward motion of the carriage 2, the carriage 2 moves in the opposite direction of the scanning direction 'S' under a situation where all the UVLEDs of the ultraviolet irradiation unit 14*a*, the ultraviolet irradiation unit 14*b*, the ultraviolet irradiation unit 15*a*, and the ultraviolet irradiation unit 15*b* are turned on. As a result of that, the color ink applied to the area P11 is hardened by means of more ultraviolet irradiation.

Next, as shown in FIG. 8A and FIG. 8B, the medium 'M' is transferred only for a pass width in the feed direction 'F' so as to have an area P12 of the medium 'M' meet the scanning line of the first discharge area A1, and also have the area P11 of the medium 'M' meet a scanning line of the second discharge area A2, and then the carriage 2 reciprocates in the scanning direction 'S'.

Then, as shown in FIG. 8A, during the outward motion of the carriage 2, the color ink is discharged from the first discharge area A1, and the clear ink is discharged from the second discharge area A2, while the carriage 2 is moving in the scanning direction 'S' under a situation where the UVLEDs of the ultraviolet irradiation unit 14*a* and the ultraviolet irradiation unit 15*a* are turned on. As a result of that, the color ink discharged from the first discharge area A1 is applied to the area P12, and also irradiated with ultraviolet so as to be hardened, immediately after being applied to the area P12; and meanwhile the clear ink discharged from the second discharge area A2 is applied to the surface of the color ink hardened in the area P11. Since the UVLEDs of the ultraviolet irradiation unit 14*b* and the ultraviolet irradiation unit 15*b* are turned off under this situation, the clear ink applied to the surface of the color ink, hardened in the area P11, further decreases in its thickness without hardening to become leveled.

In contrast, as shown in FIG. 8B, during the backward motion of the carriage 2, the carriage 2 moves in the opposite direction of the scanning direction 'S' under a situation where all the UVLEDs of the ultraviolet irradiation unit 14*a*, the ultraviolet irradiation unit 14*b*, the ultraviolet irradiation unit 15*a*, and the ultraviolet irradiation unit 15*b* are turned on. As a result of that, the color ink applied to the area P12 and the clear ink applied to the area P11 are hardened by means of ultraviolet irradiation.

According to the second embodiment in this way, during the reciprocating motion of the carriage 2, a blur of the color ink can be controlled by means of turning on the ultraviolet irradiation unit 14*a* and the ultraviolet irradiation unit 15*a*, and meanwhile a smoothness of the clear ink can be improved by means of a repeat of turning on and off the ultraviolet irradiation unit 14*b* and the ultraviolet irradiation unit 15*b*.

Third Embodiment

Next, an inkjet printer according to a third embodiment is explained. In the third embodiment, a coated film of clear ink is formed on a medium on which a color image is already formed. Although, being fundamentally similar to the inkjet printer 1 according to the first embodiment, the inkjet printer according to the third embodiment is different from the inkjet printer 1 according to the first embodiment, based on a viewpoint that ink is discharged from an entire area of the lines of nozzles of the inkjet heads 6. Thus, in an explanation below, only a difference from the first embodiment is explained, and an explanation is omitted on the same part as the first embodiment has.

Figure 9:
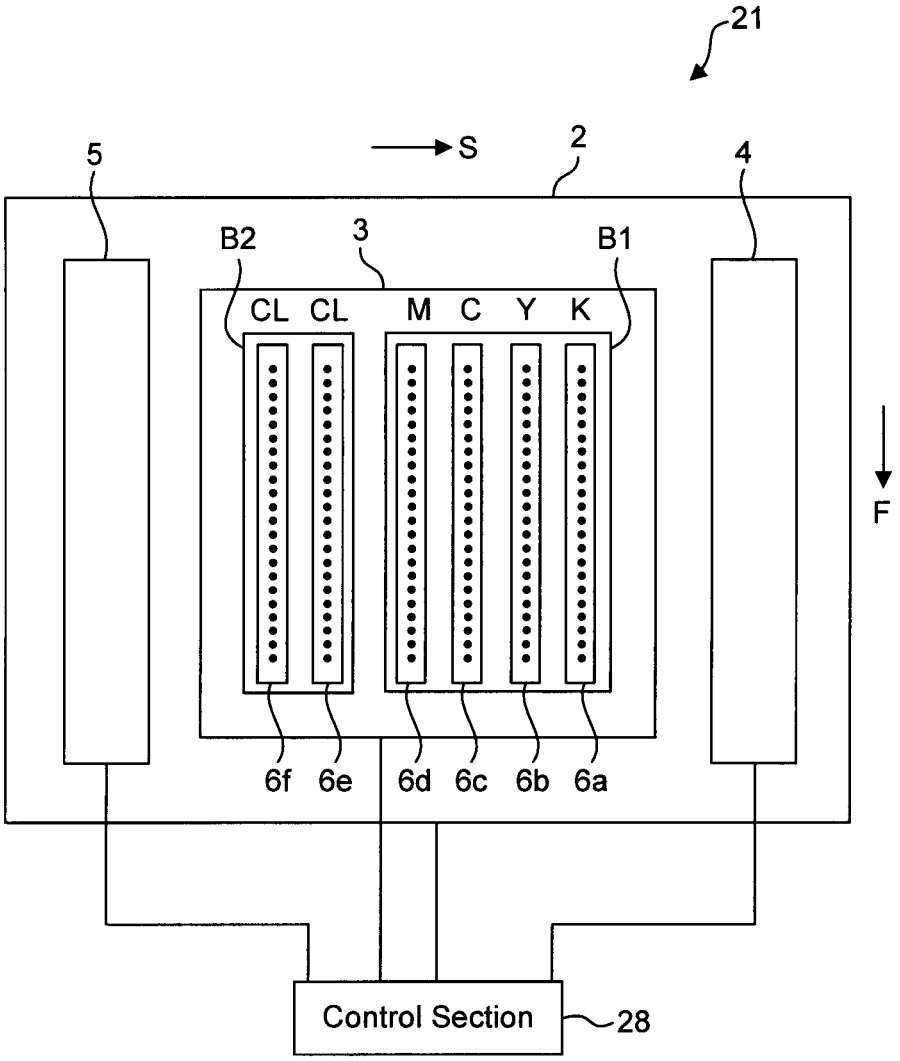
FIG. 9 is a schematic view showing an inkjet printer according to a third embodiment.

FIG. 9 is a schematic view showing an inkjet printer according to the third embodiment. As shown in FIG. 9, an inkjet printer 21 according to the third embodiment includes a carriage 2 that can reciprocate in a scanning direction 'S', a head unit 3 that is installed in the carriage 2 and equipped with a plurality of inkjet heads 6, an ultraviolet irradiation unit 4 that is installed in the carriage 2 and placed before the head unit 3 in the scanning direction 'S', an ultraviolet irradiation unit 5 that is installed in the carriage 2 and placed after the head unit 3 in the scanning direction 'S', and a control section 28 for controlling the carriage 2, the inkjet heads 6, the ultraviolet irradiation unit 4, and the ultraviolet irradiation unit 4. Then, by means of transferring a medium each time for a distance of a pass width in a feed direction 'F' perpendicular to the scanning direction 'S', and also carrying out scanning operation with discharging ultraviolet curable ink out of the inkjet heads 6 while moving the carriage 2 in the scanning direction 'S', and irradiation with ultraviolet from the ultraviolet irradiation unit 4 as well as the ultraviolet irradiation unit 5, the inkjet printer 21 forms an image on the medium, in the same manner as the inkjet printer 1 according to the first embodiment does.

The plurality of inkjet heads 6 (from 6*a* through 6*f*) for discharging the ultraviolet curable ink are assembled in the head unit 3, in the same manner as they are in the first embodiment. Then, color ink is discharged from a first discharge area B1 of the entire area of the lines of nozzles formed in the inkjet head 6*a* through the inkjet head 6*d*, and clear ink is discharged from a second discharge area B2 of the entire area of the lines of nozzles formed in the inkjet head 6*e* and the inkjet head 6*f*.

The control section 28 controls printing operation of the inkjet printer 21, and it is configured with a computer as a key unit, the computer including, for example, a CPU, a ROM, and a RAM. Each operation control of the control section 28, to be described later, is put into practice by way of loading predetermined computer software into the CPU and/or the RAM, and executing the software under the control of the CPU.

The control section 28 controls driving operation of the carriage 2 to reciprocate the carriage 2 in the scanning direction 'S'.

Furthermore, the control section 28 controls ink discharging operation of the inkjet heads 6 during the outward motion of the carriage 2 to discharge the clear ink from the second discharge area B2. Incidentally, the control section 28 also discharges the color ink from the first discharge area B1, as required.

Furthermore, during the backward motion of the carriage 2, the control section 28 controls ultraviolet irradiating operation of the ultraviolet irradiation unit 4 and the ultraviolet irradiation unit 5 to turn on the UVLEDs of the ultraviolet irradiation unit 4 and the ultraviolet irradiation unit 5. Namely, the control section 28 turns on the UVLEDs of the ultraviolet irradiation unit 4, and the ultraviolet irradiation unit 5 at the time of starting the backward motion of the carriage 2, and it turns off the UVLEDs of the ultraviolet irradiation unit 4, and the ultraviolet irradiation unit 5 at the end of the backward motion. Thus, during the outward motion of the carriage 2, the UVLEDs of the ultraviolet irradiation unit 14*a*, the ultraviolet irradiation unit 14*b*, the ultraviolet irradiation unit 15*a*, and the ultraviolet irradiation unit 15*b* keep on being lighted. Incidentally, the control section 28 may keep the UVLEDs of the ultraviolet irradiation unit 4 and the ultraviolet irradiation unit 5 turned on only while the carriage 2 is moving over the medium or the printed image, and it may keep the UVLEDs of the ultraviolet irradiation unit 4 and the ultraviolet irradiation unit 5 lighted off while the carriage 2 is not positioned over the medium or the printed image.

Figure 10:
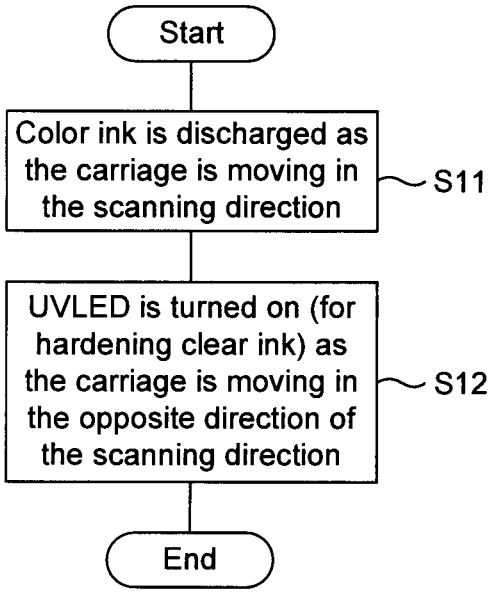
FIG. 10 is a flowchart showing a process workflow of a control section.

Next, a printing method for forming a coated film of clear ink on a medium, on which a color image is already formed, by using the inkjet printer 11 is explained with reference to FIG. 10. FIG. 10 is a flowchart showing a process workflow of the control section.

At first, the control section 28 controls driving operation of the carriage 2 to reciprocate the carriage 2 in the scanning direction 'S'.

Then, during the outward motion of the carriage 2, the control section 28 controls ink discharging operation of the inkjet heads 6, while moving the carriage 2 in the scanning direction 'S', in order to discharge the clear ink from the second discharge area 62 (Step S11). The control section 28 controls ink discharging operation of the inkjet heads 6 in such a way as to discharge an increased amount of clear ink per unit area than usual so that the clear ink discharged from each of the inkjet heads 6 amounts to 1,400 to 3,400 pl/mm2. Incidentally, at Step S11, the control section 28 may discharge 5 vol. percent of the color ink from the first discharge area B1, in proportion to the clear ink discharged from the second discharge area B2. As a result of that, the clear ink discharged from the second discharge area B2 can be mixed with the color ink discharged from the first discharge area B1.

As the clear ink is discharged from the second discharge area B2 in this way, liquid drops of the clear ink discharged from the second discharge area B2 are landed on the medium 'M' so that the clear ink is applied to a surface of the medium. Then, the clear ink is not yet hardened at the stage, and therefore each of the liquid drops of the clear ink applied to the medium 'M' extends gradually under wet condition to decrease in its thickness so that an uneven surface of the clear ink is leveled. Moreover, because of high density of the liquid drops of the clear ink, contact and mixing of the neighboring liquid drops of the clear ink among their interrelation are likely to happen so that each of the liquid drops of the clear ink further decreases in its thickness to promote leveling of the clear ink.

Then, during the backward motion of the carriage 2, the control section 28 controls ultraviolet irradiating operation of the ultraviolet irradiation unit 4 and the ultraviolet irradiation unit 5, while moving the carriage 2 in the scanning direction 'S', in order to turn on the UVLED of the ultraviolet irradiation unit 4 and the UVLED of the ultraviolet irradiation unit 5 (Step S12). Accordingly, the clear ink applied to the medium 'M' is hardened by way of irradiation with the ultraviolet emitted from the UVLEDs turned on.

After the reciprocating motion of the carriage 2 in the scanning direction 'S' finishes, the control section 8 turns off the UVLED of the ultraviolet irradiation unit 14 and the UVLED of the ultraviolet irradiation unit 15. Then, the control section 28 repeats the steps described above until an entire image is formed.

Figure 11A:
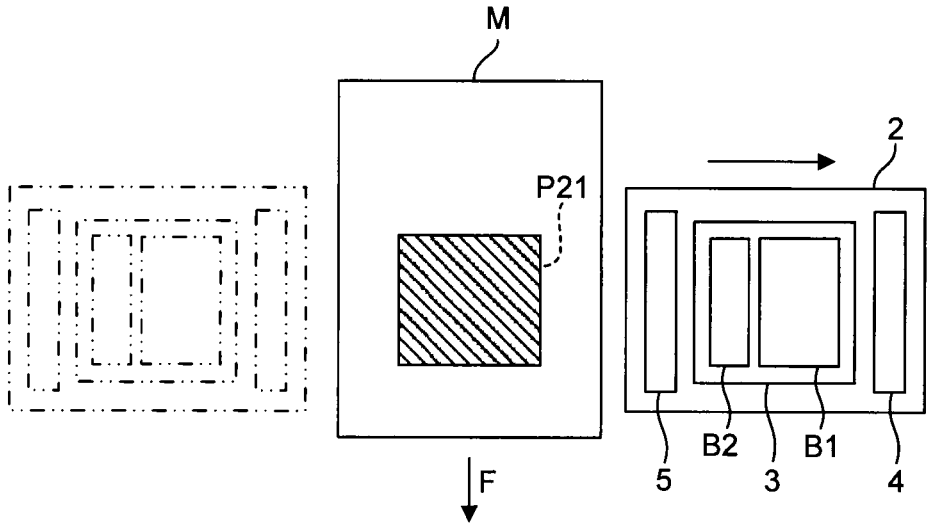
FIG. 11A and FIG. 11B are diagrams showing an exemplary operation for explaining a printing operation.
Figure 11B:
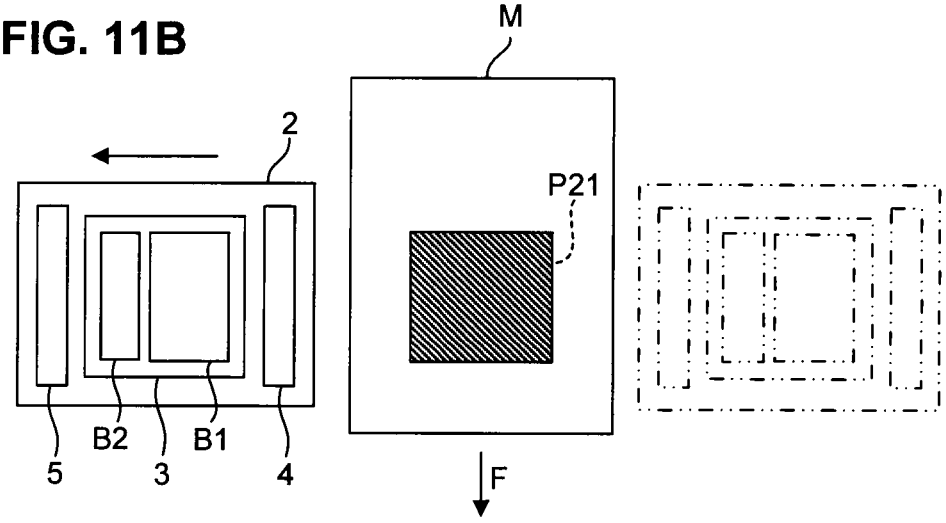

An example of printing operation according to the method described above is specifically explained with reference to FIG. 11A and FIG. 11B. FIG. 11A and FIG. 11B are diagrams showing an operation example for explaining printing operation.

At first, as shown in FIG. 11A and FIG. 11B, the carriage 2 is reciprocated in the scanning direction 'S' so as to have an area P21 of the medium 'M' meet a scanning line of the first discharge area B1 and the second discharge area B2.

Then, as shown in FIG. 11A, during the outward motion of the carriage 2, the clear ink is discharged from the second discharge area B2, while the carriage 2 is moving in the scanning direction 'S' under a situation where the UVLEDs of the ultraviolet irradiation unit 4 and the ultraviolet irradiation unit 5 are turned off. As a result of that, the clear ink discharged from the second discharge area B2 is applied to the area P21. Incidentally, in order to mix the clear ink with the color ink, 5 vol. percent of the color ink is discharged from the first discharge area B1, in proportion to the clear ink discharged from the second discharge area B2. As a result of that, being mixed with each other, the color ink and the clear ink are applied to the area P21.

In contrast, as shown in FIG. 11B, during the backward motion of the carriage 2, the carriage 2 moves in the opposite direction of the scanning direction 'S' under a situation where the UVLEDs of the ultraviolet irradiation unit 4 and the ultraviolet irradiation unit 5 are turned on. As a result of that, the clear ink applied to the area P21 is hardened by means of ultraviolet irradiation.

Thus, according to the third embodiment, additional effects mentioned below can be achieved besides the effects described above. More specifically, when the clear ink is discharged from the entire area of the lines of nozzles during the outward motion of the carriage 2, and the clear ink is irradiated with ultraviolet during the backward motion of the carriage 2, making effective use of the lines of nozzles of the inkjet heads 6 makes it possible to form a coated film of clear ink, having its leveled surface, on the medium.

Then, the color ink and the clear ink can be mixed by discharging the color ink and the clear ink almost at the same time during the outward motion of the carriage 2, and the color ink and the clear ink under the mixed condition can be hardened by irradiation with ultraviolet during the backward motion of the carriage 2. By way of these steps, a colored coated film of clear ink can be formed on the surface of the medium.

Described above are the preferred embodiments of the present invention. Incidentally, the present invention is not limited to those embodiments. For example, the first embodiment and the second embodiment explain that the first discharge area A1 for discharging the color ink is materialized with the lines of nozzles placed as a rear half in the feed direction 'F', and the second discharge area A2 for discharging the clear ink is materialized with the lines of nozzles placed as a front half of the inkjet heads 6 in the feed direction 'F'. Nevertheless, each of the first discharge area A1 and the second discharge area A2 may be materialized with lines of nozzles as a whole, as explained in the third embodiment. In this case, since the first discharge area A1 and the second discharge area A2 are located at the same position in the feed direction 'F', the color ink and the clear ink are discharged separately. More specifically, at first the medium is transferred in the feed direction 'F', and then a color image is printed by discharging the color ink from the first discharge area A1. Subsequently, the medium is once restored to a former position. Then, the medium is transferred again in the feed direction 'F', and the clear ink is applied to a surface of the color image by discharging the clear ink from the second discharge area A2.

The first embodiment and the second embodiment explain that only the first discharge area A1 and the second discharge area A2 of the inkjet heads 6 discharge the ultraviolet curable ink. Nevertheless, for example, the color ink may be discharged from an area located as a front half in the feed direction 'F' of the lines of nozzles of the inkjet head 6*a* through the inkjet head 6*d*; the color ink amounting to 5 vol. percent or less, in proportion to the clear ink discharged from the second discharge area A2. According to this configuration, the clear ink is mixed with 5 vol. percent or less of the color ink, by means of one-time scanning operation, so that a colored coated film of clear ink can be formed as described in the third embodiment.

The first embodiment and the second embodiment explain that the inkjet head 6*a* through the inkjet head 6*f* are located at the same position in the feed direction 'F', and the first discharge area A1 and the second discharge area A2 are formed by way of discharging from only a part of the inkjet heads. Nevertheless, for example, the inkjet head 6*a* through the inkjet head 6*f* may be displaced in the feed direction 'F' in such a way that the inkjet head 6*e* and the inkjet head 6*f* are positioned ahead of the inkjet head 6*a* through the inkjet head 6*d* in the feed direction 'F', in order to form the first discharge area A1 and the second discharge area A2.

Although the embodiments described above explain that each of the inkjet heads 6 discharges only one kind of ink, a plurality of nozzle lines may be formed in the scanning direction 'S', and each nozzle line may discharge a specific kind of ink. Furthermore, although it is explained with respect to the inkjet heads for discharging the color ink that only one head is installed for each color in the head unit 3, a plurality of heads may be installed for each color. Meanwhile, there exists no restriction in relation to a layout of the inkjet heads for discharging the color ink and the inkjet heads for discharging the clear ink, and a modified layout may be applied.

Although the embodiments described above give no explanation in regard to switching operation from the outward motion to the backward motion of the carriage 2, for example, the backward motion may start after spending a predetermined standby time following the outward motion of the carriage 2 if sufficient leveling cannot be achieved due to poor compatibility between a medium and clear ink. By proceeding with operation this way, the clear ink extends more under wet condition so that leveling can be further promoted.

Although the embodiments described above explain about printing operation of printing with two pass operations, there is no restriction in relation to the number of pass operations. For example, in the case of printing with 12 pass operations, the lines of nozzles of the inkjet heads 6 are divided by the number of pass operations, i.e., '12', to calculate a width (pass width), and the width is used as one medium feed distance for printing by way of scanning a certain area 12 times (the number of pass operations).

Although the embodiments described above explain a use of a UVLED as an ultraviolet irradiation unit, any other ultraviolet irradiation system such as a metal halide lamp may be used as far as it can irradiate ultraviolet curable ink with ultraviolet. Incidentally, when a metal halide lamp is used, installation of a shutter and a shutter operation unit enables choosing to turn on or off ultraviolet irradiation.

Although the embodiments described above explain that two ultraviolet irradiation units are placed, while one being at the front and the other being at the rear in the scanning direction of the inkjet heads, only one of the two may be used as far as it can harden the ultraviolet curable ink applied to the medium.

What is claimed is:

1. An image forming device for discharging an ultraviolet curable ink onto a recording medium, comprising:

a carriage configured to reciprocate in a scanning direction;

an ink discharger installed in the carriage having a plurality of nozzles formed into rows for discharging liquid drops of ultraviolet curable ink, including ultraviolet curable color ink and ultraviolet curable ink with translucency;

a first ultraviolet irradiator and a second ultraviolet irradiator installed in the carriage for emitting ultraviolet radiation; and a controller for controlling a transfer operation by the carriage, an ink discharging operation by the ink discharger, and an ultraviolet irradiation operation by the first ultraviolet irradiator and the second ultraviolet irradiator;

wherein, during outward motions of the carriage, the controller controls the ink discharger to discharge the ultraviolet curable color ink and the ultraviolet curable ink with translucency toward the recording medium;

wherein, during backward motions of the carriage, the controller controls the first ultraviolet irradiator to emit ultraviolet radiation to the ultraviolet curable color ink having been discharged onto the recording medium, and the second ultraviolet irradiator to emit ultraviolet radiation to the ultraviolet curable ink with translucency having been discharged onto the recording medium;

wherein, during an outward motion of the carriage and while the second ultraviolet irradiator is off, the controller controls the first ultraviolet irradiator to emit ultraviolet radiation to the ultraviolet curable color ink having been discharged onto the recording medium;

wherein, during a backward motion of the carriage subsequent to the outward motion of the carriage in which the first ultraviolet irradiator had emitted ultraviolet radiation to the ultraviolet curable color ink having been discharged onto the recording medium, the controller has the first ultraviolet irradiator emit ultraviolet radiation to the ultraviolet curable color ink having been discharged onto the recording medium;

wherein the controller has the second ultraviolet irradiator emit ultraviolet radiation to the ultraviolet curable ink with translucency having been discharged onto the recording medium during a backward motion of the carriage subsequent to an outward motion of the carriage in which ultraviolet curable ink with translucency had been discharged onto the recording medium;

wherein the plurality of nozzles configured for discharging ultraviolet curable ink with translucency forms more rows of nozzles than the plurality of nozzles configured for discharging ultraviolet curable color ink of a single color, the controller configured to discharge more of the ultraviolet curable ink with translucency than the ultraviolet curable color ink of the single color, at one time and cure the ultraviolet curable ink with translucency after leveling of the discharged ultraviolet curable ink with translucency; and wherein an amount of the ultraviolet curable ink discharged by the ink discharger through one-time scanning is within a range of 1,400 to 3,400 pl/mm2.

2. An image forming device for discharging an ultraviolet curable ink onto a recording medium, comprising:

a carriage configured to reciprocate in a scanning direction;

an ink discharger installed in the carriage having a plurality of nozzles formed into rows for discharging liquid drops of ultraviolet curable ink, including ultraviolet curable color ink and ultraviolet curable ink with translucency;

a first ultraviolet irradiator and a second ultraviolet irradiator installed in the carriage for emitting ultraviolet radiation; and a controller for controlling a transfer operation by the carriage, an ink discharging operation by the ink discharger, and an ultraviolet irradiation operation by the ultraviolet irradiator;

wherein, during outward motions of the carriage, the controller controls the ink discharger to discharge the ultraviolet curable color ink and the ultraviolet curable ink with translucency toward the recording medium;

wherein, during backward motions of the carriage, the controller controls the first ultraviolet irradiator to emit ultraviolet radiation to the ultraviolet curable color ink having been discharged onto the recording medium, and the second ultraviolet irradiator to emit ultraviolet radiation to the ultraviolet curable ink with translucency having been discharged onto the recording medium;

wherein, during an outward motion of the carriage and while the second ultraviolet irradiator is off, the controller controls the first ultraviolet irradiator to emit ultraviolet radiation to the ultraviolet curable color ink having been discharged onto the recording medium;

wherein, during a backward motion of the carriage subsequent to the outward motion of the carriage in which the first ultraviolet irradiator had emitted ultraviolet radiation to the ultraviolet curable color ink having been discharged onto the recording medium, the controller has the first ultraviolet irradiator emit ultraviolet radiation to the ultraviolet curable color ink having been discharged onto the recording medium;

wherein the controller has the second ultraviolet irradiator emit ultraviolet radiation to the ultraviolet curable ink with translucency having been discharged onto the recording medium during a backward motion of the carriage subsequent to an outward motion of the carriage in which ultraviolet curable ink with translucency had been discharged onto the recording medium;

wherein the plurality of nozzles configured for discharging ultraviolet curable ink with translucency forms more rows of nozzles than the plurality of nozzles configured for discharging ultraviolet curable color ink of a single color;

wherein the controller has the ink discharger alternate between discharging the ultraviolet curable color ink and discharging the ultraviolet curable ink with translucency during consecutive outward motions of the carriage; and wherein the controller has the first ultraviolet irradiator and the second ultraviolet irradiator alternate between emitting ultraviolet radiation to the respective ultraviolet curable color ink having been discharged onto the recording medium and the ultraviolet curable ink with translucency having been discharged onto the recording medium during consecutive backward motions of the carriage.

3. An image forming device for discharging an ultraviolet curable ink onto a recording medium, comprising:

a carriage configured to reciprocate in a scanning direction;

an ink discharger installed in the carriage configured to discharge liquid drops of ultraviolet curable ink, including ultraviolet curable color ink and ultraviolet curable ink with translucency;

a first ultraviolet irradiator and a second ultraviolet irradiator installed at opposite ends of the carriage in the scanning direction configured to emit ultraviolet radiation; and a controller for controlling a transfer operation of the carriage, an ink discharging operation of the ink discharger, and an ultraviolet irradiation operation of the first ultraviolet irradiator and the second ultraviolet irradiator;

wherein the ink discharger comprises a plurality of inkjet heads arrayed from front to rear in the scanning direction, the plurality of inkjet heads comprising a plurality of nozzles arranged into rows extending in a feed direction perpendicular to the scanning direction, wherein each of the first ultraviolet irradiator and the second ultraviolet irradiator are arranged to span an entire length of the rows of the nozzles in the feed direction, so as to be capable of irradiating the entire length of the rows of the nozzles, and wherein the controller is configured to:

during outward motions of the carriage or backward motions of the carriage, control the ink discharger to discharge the ultraviolet curable color ink toward the recording medium from a first portion of the rows of the nozzles in a first discharge area in a rear side in the feed direction, and discharge the ultraviolet curable ink with translucency toward the recording medium from a second portion of the rows of the nozzles in a second discharge area in a top side in the feed direction, and control the first ultraviolet irradiator and the second ultraviolet irradiator to emit ultraviolet radiation toward the recording medium in a region corresponding to the first discharge area or the second discharge area.

4. The image forming device according to claim 3, wherein the controller is further configured to control the first ultraviolet irradiator or the second ultraviolet irradiator to emit ultraviolet radiation toward the recording medium from a portion of the first ultraviolet irradiator or the second ultraviolet irradiator corresponding to the first discharge area or the second discharge area.

* * * * *